United States Patent [19]

Teetzel et al.

[11] 4,275,529

[45] Jun. 30, 1981

[54] HIGH FLAP DENSITY ABRASIVE FLAP WHEEL

[75] Inventors: Michael L. Teetzel, Columbus Twp., Anoka County; Ralph E. James, White Bear Lake, both of Minn.

[73] Assignee: Minnesota Mining and Manufacturing Company, Saint Paul, Minn.

[21] Appl. No.: 70,691

[22] Filed: Aug. 28, 1979

[51] Int. Cl.[3] ..... B24B 9/02; B24D 11/00

[52] U.S. Cl. ..... 51/334; 51/394

[58] Field of Search ..... 51/334–337, 51/406, 394, 395, 397, 401; 15/230.12, 230.14, 230.16

[56] References Cited

U.S. PATENT DOCUMENTS

| | | | |
|---|---|---|---|
| 3,053,021 | 9/1962 | Block | 51/337 |
| 3,468,642 | 9/1969 | Burns | 51/337 |
| 3,548,550 | 12/1970 | McAleer | 51/334 |
| 3,548,551 | 12/1970 | Block | 51/337 |
| 3,585,765 | 6/1971 | McAleer | 51/334 |
| 3,706,167 | 12/1972 | Schaffner | 51/334 |

FOREIGN PATENT DOCUMENTS

| | | | |
|---|---|---|---|
| 593766 | 3/1973 | Switzerland | 51/334 |

*Primary Examiner*—Harold D. Whitehead
*Assistant Examiner*—K. Bradford Adolphson
*Attorney, Agent, or Firm*—Cruzan Alexander; Donald M. Sell; Richard Francis

[57] ABSTRACT

An improved abrasive flap wheel is comprised of a highly compacted annulus of like-oriented, radially disposed, interleaved coated abrasive flaps and resilient, lofty, non-woven flaps adhesively fastened together at adjacent inner ends. The abrasive flap wheel is made by compressing a stack of juxtaposed flaps of a desired distribution to form a block substantially the same length as the inner perimeter of the annulus, fastening together the ends of the flaps on the surface of the block which will become the inner surface of the annulus and forming the block into an annulus with the free ends of the flaps directed radially outward. The inner ends of the flaps are adhesively fastened together in the process. The degree of annulus compaction is reflected by the compressed thickness of the ends of the non-woven flaps at the inner perimeter which is less than approximately 35% as thick as their uncompressed outer ends. The compacted flap wheel of the invention has a much higher abrasive grain efficiency than conventional less compacted flap wheels.

4 Claims, 7 Drawing Figures

HIGH FLAP DENSITY ABRASIVE FLAP WHEEL

BACKGROUND OF THE INVENTION

1. Field of the Invention

This invention relates to an improved abrasive flap wheel comprising interleaved coated abrasive flaps and non-woven flaps and having a high flap density.

2. Prior Art

Coated abrasive flap wheels, which comprise an annulus of juxtaposed radially extended coated abrasive elements, have been known for at least 75 years. Scores of patents have issued on variations of this general configuration.

A particularly useful abrasive flap wheel is provided by a wheel which has an annulus of interleaved coated abrasive flaps and non-woven abrasive flaps. A highly commercially successful example of such an abrasive flap wheel is being marketed by the assignee of the present application under the trade designation "PGC" abrasive wheel. This type of abrasive flap wheel is also described in U.S. Pat. No. 3,706,167 by Robert D. Schaffner, assigned to Schaffner Manufacturing Company, Inc.

Such abrasive flap wheels are prepared by forming and adhesively bonding inner flap ends of an annulus of a moderately compressed stack of the desired distribution of non-woven flaps and coated abrasive flaps. Such moderate compression typically results in an annulus with the non-woven flap ends adjacent the inner perimeter of the wheel being at least about 40% as thick as their uncompressed ends.

SUMMARY OF THE PRESENT INVENTION

The present invention provides a novel improved flap wheel comprising interleaved coated abrasive flaps and non-woven flaps which contains more flaps than the same type prior art flap wheel of the same diameter thereby providing a compacted or densified flap wheel. The flap wheel of the present invention is prepared in the same manner as the prior art flap wheels, except the initial stack of interleaved flaps contains more flaps and is compressed to a greater degree thereby producing a more highly compacted flap wheel.

Quite surprisingly, the flap wheel of the present invention has a significantly increased grain efficiency, of as much as 100% or more. (Grain efficiency is the quotient of the weight of material removed from a workpiece divided by the weight loss of the abrasive flap wheel during such removal). This is particularly significant since it provides a considerable economic advantage with very little increase in cost caused by the extra flaps.

The rotative abrasive flap wheels of the invention comprise an annulus of flaps formed of approximately equal-sized, rectangular, like-oriented, coated abrasive flaps generally having their abrasive faces in the same direction interleaved with lofty, compressible, non-woven flaps. The flaps are adhesively fastened together at their inner ends with adhesive which extends from the inner ends part way into the annulus. The outer flap ends of at least the coated abrasive flaps define a tubular surface providing an opening capable of receiving an arbor and having an inner perimeter defined by a plane perpendicular to the tubular surface.

The method of making the rotative abrasive flap wheel of the invention comprises first forming a stack comprising a desired interleaved arrangement of a plurality of coated abrasive flaps and a plurality of compressible, lofty, non-woven flaps in a number ratio of coated abrasive flaps to non-woven flaps of about 15:1 to about 1:5. The stack is then compacted with a compressing force to compress the non-woven flaps to less than about 35% of their original thickness into a rectangular flap block. The rectangular flap block has a first end, a second end, a length substantially equal to the inner perimeter of the annulus of the wheel to be formed, opposed side surfaces intended to provide the side edges of the wheel and, in opposed relationship, a first surface intended to provide the inner surface of the wheel and a second surface intended to provide the outer surface of the wheel. The ends of the flaps at the first surface of the block are then fastened together with flexible fastening means to prevent expansion of the first surface upon release of the compressing force, while leaving unfastened the ends of the flaps at the second surface. Liquid curable adhesive is then applied to the first surface and permitted to partially penetrate into the block adjacent the first surface. Thereafter, the compressing force is released to permit the expansion of the unfastened ends of the non-woven flaps. The resultant structure is then arranged into an annulus with the fastened flap ends inward and the unfastened flap ends outward. The liquid curable adhesive is then cured. It should be noted that the step applying liquid curable adhesive may alternatively be after fastening the flap ends, releasing compression, or arranging the block into an annulus.

The degree of compaction of the compacted annulus of the flap wheel of the present invention may be recognized by comparing the thickness of the non-woven flap ends adjacent the inner perimeter of the wheel with the thickness of their uncompressed free ends. The thickness of a compressed non-woven flap end at the inner perimeter or, if the flap does not reach the inner perimeter, if it were extended to the inner perimeter, is less than about 35% of the thickness of its uncompressed end. By contrast, the thickness of the compressed non-woven flap of a prior art wheel will be greater than about 40% as thick as the uncompressed outer end.

In determining the thickness of the compressed non-woven flap end extended to the inner perimeter, the term "extended," in describing the position of the non-woven flap inner end, refers to flap ends which actually reach the inner perimeter and also to flap ends which do not actually reach the inner perimeter. The term "extended" in the latter case refers to lines generated by extending the flap upper and lower surface from the actual flap end to the inner perimeter. The flap thickness in such case will be the space between the generated lines at the point where they intersect the inner perimeter.

DRAWING

For further understanding of this invention, reference is made to the attached drawings in which like numbers identify like parts in the several views and in which.

DETAILED DESCRIPTION

Figure 1:
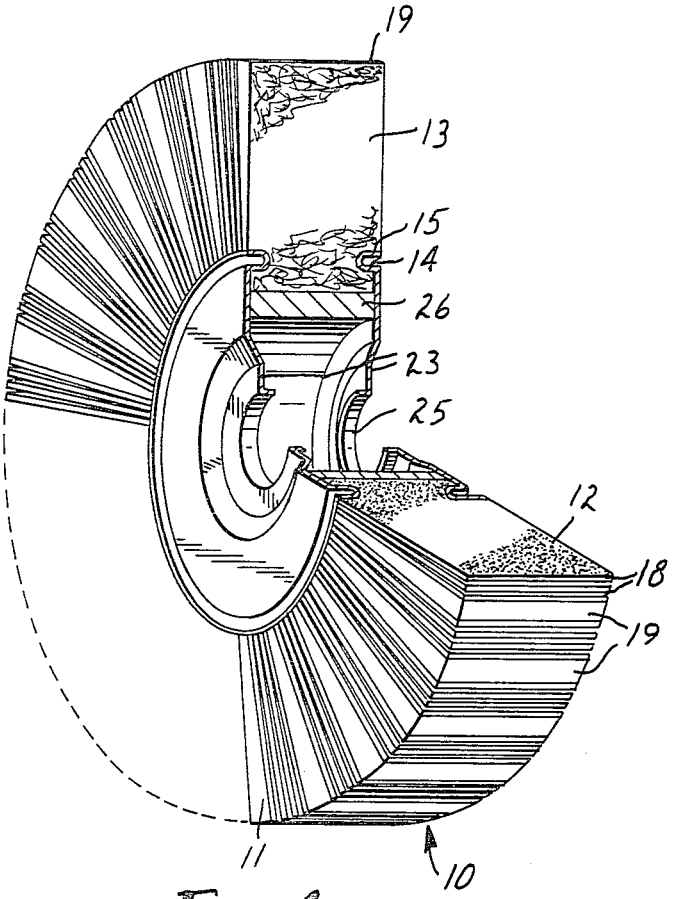
FIG. 1 is a perspective view of an abrasive flap wheel made in accordance with the present invention with certain parts shown broken away for purposes of clarity.
Figure 3:
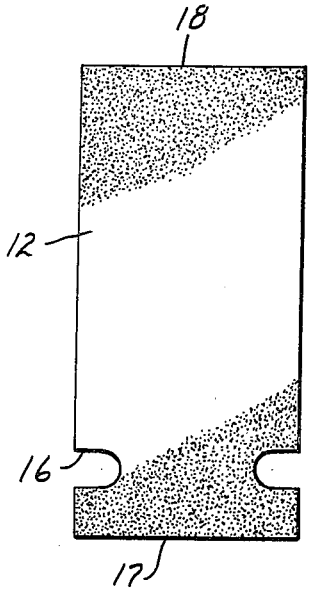
FIG. 3 is a plan view of a coated abrasive flap employed in the abrasive flap wheel depicted in FIG. 1.
Figure 2:
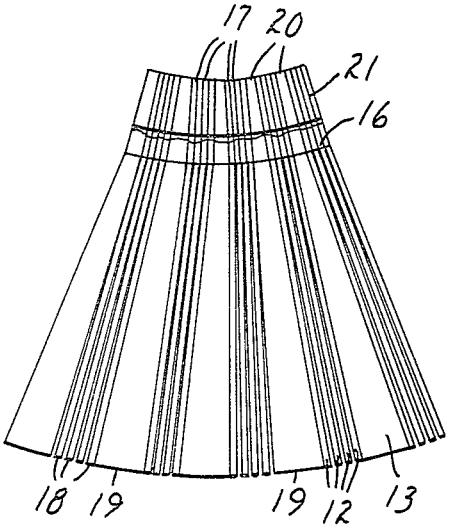
FIG. 2 is an enlarged side plan view showing a portion of the annulus of flaps of the wheel depicted in FIG. 1.
Figure 4:
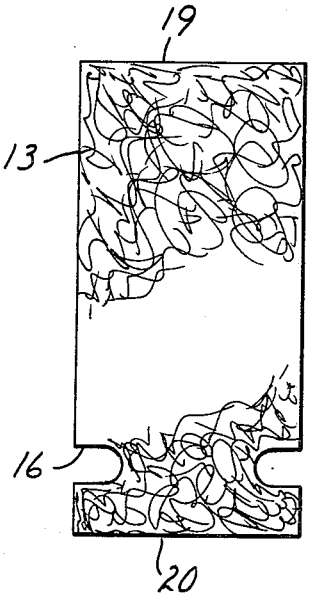
FIG. 4 is a plan view of a resilient, lofty, non-woven flap employed in the abrasive flap wheel depicted in FIG. 1.

In FIG. 1 of the drawing, flap wheel 10 is made of an annulus 11 of slotted, substantially rectangular, like-oriented coated abrasive flaps 12 interleaved with non-woven flaps 13 and includes circular side plates 23, each of which has a flange portion 14 adapted to fit within respective opposed grooves defined by slots 16 located on either side of annulus 11 and having central openings 25 concentric with the axis of rotation of wheel 10. The inner ends 17 of coated abrasive flaps 12 and the inner ends 20 of compressible, lofty, non-woven flaps 13 are positioned and adhesively bonded together by adhesive binder 21 which typically extends over the area between the inner flap ends to slots 16, this area sometimes being called the "root" of the flap. At least the inner ends 17 of coated abrasive flaps 12 define a tubular surface which provides an opening for receiving a suitable arbor (not shown) to support the wheel for rotation. Ends 20 of non-woven flaps 13 may also extend to the tubular surface, but this is not necessary, provided ends 20 extend into the root area and are contacted by sufficient adhesive binder to be firmly attached therein and additionally held therein by side plates 23 such that they withstand withdrawal during the ultimate use of the wheel. Side plates 23 have centrally located openings 25 axially aligned with the tubular surface which are of a size suitable to permit the insertion of the arbor.

The wheel may also include a centrally bored core 26 within side plates 23 for attachment of the flap inner ends. Other conventional alternatives may also be included.

The key distinguishing feature between the abrasive flap wheel of the present invention and wheels of the prior art lies in the fact that non-woven flaps within the wheel of the present invention are more compacted than those of prior art wheels. Applicant has discovered that such a compacted wheel provides an unexpected increase in performance of the wheel, recognizable by a significant increase in grain efficiency, on the order of 100% or more. The more densely compacted wheel of the present invention may be distinguished from prior art wheels by comparing the thickness of the non-woven flap 20 and adjacent the inner perimeter of the annulus with its thickness adjacent its outer end 19. The flap thickness adjacent end 20 of the non-woven flap 13 in the wheel of the present invention will be less than 35% of the thickness of uncompressed outer end 19. By contrast, the corresponding flap thickness adjacent the perimeter of the annulus of a prior art wheel which is moderately compacted, according to present practice, will be 40% or more of the thickness of the uncompressed portion of the non-woven flap. In situations where the end 20 of non-woven flap 13 does not extend all the way to the inner perimeter of the wheel, the calculated thickness of the flap, if it were extended to the inner perimeter and compressed therein, would be less than 35%.

Figure 5:
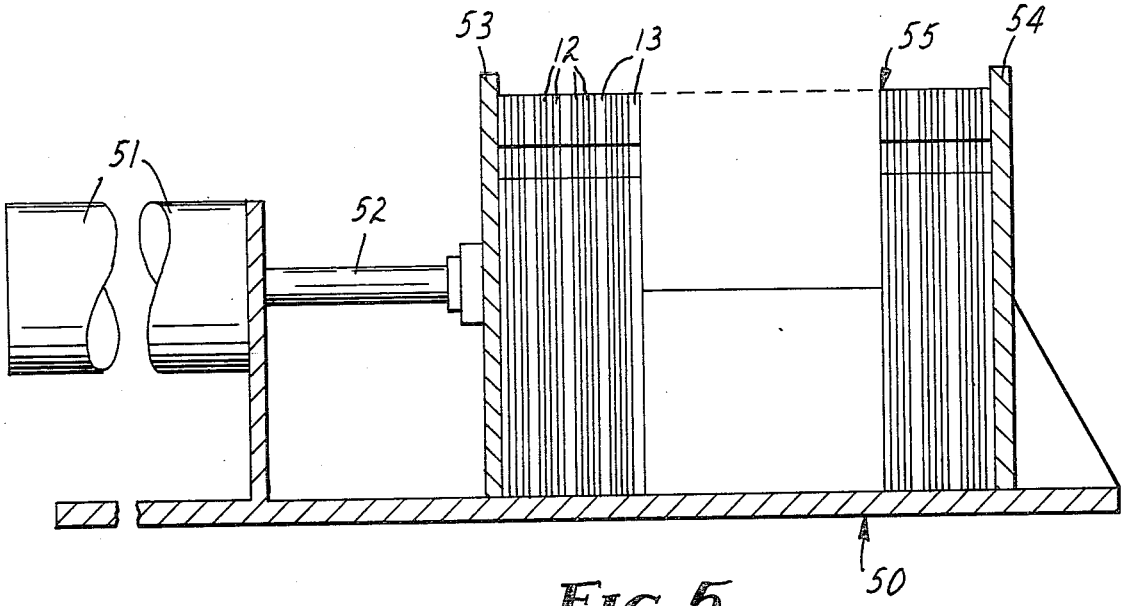
FIG. 5 is a side plan view showing an apparatus utilizing the process of the present invention for compacting or densifying a stack of flaps (also shown) which may be employed to prepare the abrasive flap wheel depicted in FIG. 1.
Figure 6:
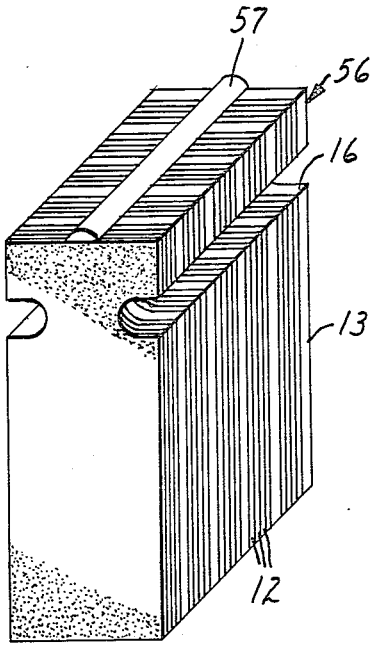
FIG. 6 is a perspective view of a block of compacted or compressed flaps produced with the apparatus shown in FIG. 5, including a strip of binder material on a surface thereof to facilitate handling.
Figure 7:
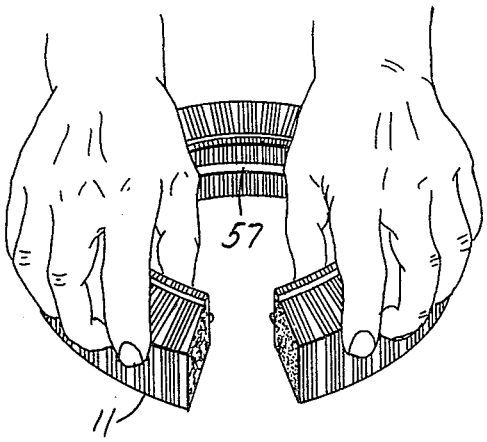
FIG. 7 is a perspective view showing the block of FIG. 6 being formed into an annulus.

Referring to FIGS. 5–7, the flap wheels of the present invention may be prepared by forming a stack 55 of a desired interleaved arrangement of a plurality of coated abrasive flaps 12 and the plurality of compressible, lofty, non-woven flaps 13 in a number ratio of coated abrasive flaps to non-woven flaps of about 15:1 to about 1:5, preferably 10:1 to about 1:1. The flaps are typically uniformly distributed with groups of coated abrasive flaps, i.e., a plurality of coated abrasive flaps (e.g., from about 1 to about 10, preferably 3 to 6 coated abrasive flaps per group) between single non-woven flaps. Stack 55 is then compressed utilizing an apparatus 50 schematically depicted in FIG. 5 which may employ piston 51 having ram 52 which is urged against a support plate 53 which compresses stack 55 against stationary back plate 54. Pressure is continued until the non-woven flaps 13 are less than 35% of their original thickness, producing a rectangular flap block 56. The flap ends adjacent the side of flap block 56 which will become the inner surface of annulus 11 are then fastened together with suitable resilient fastening means, e.g., resin strip 57, to prevent expansion of the surface upon release of the compressing force. Resin strip 57 is formed of a suitable curable adhesive which will form a tough adherent bond with the flap ends upon curing and remain sufficiently flexible to permit forming the annulus, yet will be sufficiently tough to prevent expansion of the surface of the block which will become the inner surface of the annulus upon release of the compressing force. Thereafter, as shown in FIG. 7, the block is formed into the annular shape with the block ends abutted. Other fastening means may be utilized to prevent expansion of the block upon release of the compressing force. Such fastening means may be removed at any time after the flaps have been restrained, e.g., by curing the flap adhesive or after application of at least one side plate. For example, the flaps may be mechanically fastened together with rubber bands or wire tightly passing through their aligned slots or by a suitable pressure-sensitive adhesive tape or adhesive-coated fibrous reinforcing element such as a piece of string in place of the adhesive strip.

A suitable curable liquid adhesive composition is applied to the surface of the block which will become the inner surface of the annulus to adhesively fasten the flaps together, as described above. The adhesive may be applied to the flaps before compression or to the block under compression, after releasing the compressive force, or after the block has been formed into an annulus. The root area of the block or the annulus is typically covered to form a dam, for example, made of tape, to contain the liquid adhesive in the root area prior to curing. Thereafter the liquid adhesive is cured by conventional methods and the side plates are applied in a conventional manner.

The coated abrasives employed as the abrasive flaps of the flap wheel of the present invention may be any suitable conventional coated abrasive material which will resist failure as the flap wheel is being used. The particular use therefore dictates the selection of the coated abrasive material. Preferably, the coated abrasive has a tough, tear-resistant backing such as cotton, rayon, or polyester woven into sateen, drills or jeans fabric. The coated abrasive may employ conventional abrasive binder materials to bond the abrasive granules to the backing. Such conventional binders include phenolic resins, epoxy resins and polyurethane resins. The preferred abrasive materials employed in such coated abrasives include aluminum oxide and silicon carbide. Particularly useful commercially available coated abrasives include those sold under the trade designation "3-M-ite" and "Tri-M-ite" by the 3M Company, employing resin bond fabric identified as "CI" or "XEHO" backings.

The non-woven flaps, also selected depending upon use to provide a sufficiently useful life, may be formed of non-abrasive non-woven sheet materials as well as abrasive non-woven sheet materials. The preferred non-woven flaps are made of abrasive non-woven sheet material, most preferably, those available under the trade designation "Scotch-Brite." Particularly useful materials of this type are available under the trade designation "Scotch-Brite" types "ultrafine," "superfine," or "very fine," each of these being available as types A (alumina abrasive) or S (silicon carbide abrasive). Preferred non-woven flaps will have a minimum thickness of at least 1/32 of an inch, most preferably, greater than 1/16 of an inch.

The flap dimensions may vary widely, depending on a particular use. Typically, the flaps will be on the order of ½ to 12 inches wide and 1½ to 6 inches long. Some flaps may not be completely rectangular throughout their length. For example, narrower flaps, e.g., about ½ inch wide, may have a base width wider than ½ inch at least in the root area to facilitate holding without flap loss. Wheels formed of such flaps also fall within the scope of this invention, as do wheels having flaps with other minor modifications. The wheel dimensions may also vary widely, depending on the particular use. Typical wheel dimensions include annuli having an inner perimeter of 1½ to 11 inches diameter with an outside wheel diameter of about 4 inches to 24 inches.

EXAMPLES

The invention is further illustrated by the following examples, wherein all parts are by weight, unless otherwise specified.

GENERAL DESCRIPTION

Generally, the examples of the present invention were made by die-cutting non-woven abrasive sheet material and coated abrasive sheet material in a desired size and shape, employing a punch press. The die-cut flaps were then interleaved and placed into an aligning device which holds a stack of the flaps together by their grooves so that no flaps are protruding. Pressure was then applied by an air cylinder to pack the flaps in close proximity, compressing the non-woven flaps to the required degree, and pressure sensitive adhesive tape is then wound around the portion of the compacted block of flaps below the groove and just above the groove to temporarily keep the block of flaps from extending and to provide a dam to contain the liquid binder resin to be applied later. The length of the block of abrasive flap was selected to be the same as the inside circumference of the desired finished flap wheel.

An approximately ⅛–¼ inch diameter round strip of molten polyamide thermoplastic adhesive was then applied to the block on the surface which would become the inner circumference of the flap wheel and permitted to cool to provide a means of restraining the flaps upon release. The polyamide thermoplastic binder had a softening point range according to ASTM Standard E28 of 245°–265° F., a Brookfield viscosity at 375° F. of 60–80 poise, a tensile strength of 800–1000 psi, and an elongation of 700–1000%, and a specific gravity of 0.98. Liquid epoxy resin was then poured into the area enclosed by the tape dam and the epoxy resin permitted to soak into the block. The epoxy resin consisted of a room temperature curable amine hardened Bisphenol "A"—epichlorohydrin epoxy resin. The resin was absorbed, the block removed from the holding device and, after removing the tape, laid on one side and formed into a rough circle. A ring-shaped side plate of the proper diameter was then forced into the groove to make a substantially circular shape. The block was then turned over and the other side plate inserted with the flaps ruffled to distribute them evenly. The side plates were then removed and reinserted separately after application of liquid curable silicone rubber in the groove. The liquid curable silicone rubber was a room-temperature curable fluid silicone resin commercially available from the General Electric Company under the trade designation "CE-1151." The epoxy resin and the curable silicone rubber were permitted to cure, resulting in a completed flap wheel.

Various flap wheels were prepared, some according to the prior art, i.e., having a moderately compacted annulus of flaps and others, according to the present invention, with a more highly compacted annulus of flaps. The flap wheels made according to the prior art are identified in the table as Control Examples A–D. Examples according to the present invention are identified as Examples 1–10.

In each case, for the control examples and for the examples according to the present invention, the flap wheel consisted of a plurality of "flap packets," each consisting of one non-woven abrasive flap and four coated abrasive flaps uniformly distributed about the flap wheel, although the number of packets varied depending on each example. All of the examples reported in the table included the silicone rubber material in the groove receiving the flanges of the side plates. Evaluation of flap wheels not having the silicone rubber in this groove reveals substantially no difference in performance in otherwise equivalent wheels.

The non-woven flaps of each of the examples consisted of non-woven abrasive material available from the 3M Company under the trade designation "Scotch-Brite" type A, very fine grade. This material consisted of randomly disposed crimped filaments of thermoplastic material adhesively bonded together with an adhesive binder which contains Grade 280 and finer alumina abrasive mineral. The table identifies the degree of compaction of the annulus of flaps by the "thickness percent" of the non-woven flap. The "thickness percent" is the measured or calculated thickness of the non-woven flap at the inner perimeter of the annulus times 100 divided by the uncompressed non-woven flap thickness.

The coated abrasive flaps included a phenolic size and make resin binder. The particular coated abrasive employed in a group of examples is identified in the table.

Grain Efficiency

The flap wheels identified in the table were evaluated for grain efficiency by mounting them for rotation on a variable-speed lathe, rotating a full-sized wheel at a surface speed of 6283 surface feet per minute against the steel workpiece as identified in the table. The workpiece was weighed before and after each test, as was the flap wheel, to determine the weight lost from the flap wheel and the weight lost from the workpiece during the test. The workpiece was caused to move up 2¼ inch and down 2¼ down from a center point aligned with the center of the wheel in 18 seconds for a full 9 inch cycle while maintaining a constant force designated in the table (either 10 or 15 pounds) between the workpiece and the flap wheel.

Grain efficiency, as previously mentioned, is the quotient of the weight of the material removed from the workpiece divided by the weight loss of the abrasive flap wheel during such removal.

Note in the table, the grain efficiency of the wheels according to the present invention always exceeds the grain efficiency of the corresponding control examples, typically on the order of at least 10%, and many times as much as 100% or more. This result clearly shows that the wheels of the present invention provide more cut or abrasive work per unit of abrasive material used. It should be noted that this additional cut is not as a result of the presence of additional flaps in the wheel, but as a result of the unexpected increase in the wheel use life which is larger than that expected from the additional flaps.

TABLE

| Example | Coated Abrasive | Workpiece | No. Flap Packets | Thickness (%) | Cut (g) | | Wear (g) | | Grain Efficiency | |
|---|---|---|---|---|---|---|---|---|---|---|
| | | | | | 10# | 15# | 10# | 15# | 10# | 15# |
| Control A | 180 Grade alumina bonded to treated drills weight dyed and stretched cotton fabric with phenolic make and size resin | 304 stainless steel | 62 | 43 | 68 | 87 | 23 | 78 | 3.0 | 1.2 |
| 1 | 180 Grade alumina bonded to treated drills weight dyed and stretched cotton fabric with phenolic make and size resin | 304 stainless steel | 68 | 36 | 65 | 84 | 20 | 53 | 3.3 | 1.5 |
| 2 | 180 Grade alumina bonded to treated drills weight dyed and stretched cotton fabric with phenolic make and size resin | 304 stainless steel | 74 | — | 66 | 77 | 15 | 41 | 4.4 | 1.9 |
| 3 | 180 Grade alumina bonded to treated drills weight dyed and stretched cotton fabric with phenolic make and size resin | 304 stainless steel | 81 | 26 | 60 | 78 | 16 | 27 | 3.8 | 2.9 |
| Control B | 180 Grade alumina bonded to treated drills weight dyed and stretched cotton fabric with phenolic make and size resin | 1018 cold rolled steel | 62 | 43 | 105 | 133 | 27 | 77 | 3.9 | 1.7 |
| 4 | 180 Grade alumina bonded to treated drills weight dyed and stretched cotton fabric with phenolic make and size resin | 1018 cold rolled steel | 68 | 36 | 95 | 137 | 21 | 74 | 4.5 | 1.9 |
| 5 | 180 Grade alumina bonded to treated drills weight dyed and stretched cotton fabric with phenolic make and size resin | 1018 cold rolled steel | 74 | — | 104 | 136 | 19 | 45 | 5.5 | 3.0 |
| 6 | 180 Grade alumina bonded to treated drills weight dyed and stretched cotton fabric with phenolic make and size resin | 1018 cold rolled steel | 81 | 24 | 118 | 147 | 20 | 38 | 5.9 | 3.9 |
| Control C | 80 Grade alumina bonded to dyed and stretched treated drills weight rayon fabric backing with phenolic make and size resin | 304 stainless steel | 57 | 46 | 104 | 135 | 18 | 44 | 5.8 | 3.1 |
| 7 | 80 Grade alumina bonded to dyed and stretched treated drills weight rayon fabric backing with phenolic make and size resin | 304 stainless steel | 63 | 36 | 84 | 145 | 12 | 34 | 7.1 | 4.3 |
| 8 | 80 Grade alumina bonded to dyed and stretched treated drills weight rayon fabric backing with phenolic make and size resin | 304 stainless steel | 68 | 29 | 82 | 143 | 14 | 39 | 5.9 | 3.7 |
| Control D | 80 Grade alumina bonded to dyed and stretched treated drills weight rayon fabric backing with phenolic make and size resin | 1018 cold rolled steel | 57 | 46 | 115 | 113 | 30 | 75 | 5.2 | 1.5 |
| 8 | 80 Grade alumina bonded to | 1018 cold | 63 | 36 | 167 | 220 | 27 | 66 | 6.2 | 3.3 |

TABLE-continued

| Example | Coated Abrasive | Workpiece | No. Flap Packets | Thickness (%) | Cut (g) | | Wear (g) | | Grain Efficiency | |
|---|---|---|---|---|---|---|---|---|---|---|
| | | | | | 10# | 15# | 10# | 15# | 10# | 15# |
| | dyed and stretched treated drills weight rayon fabric backing with phenolic make and size resin | rolled steel | | | | | | | | |
| 9 | 80 Grade alumina bonded to dyed and stretched treated drills weight rayon fabric backing with phenolic make and size resin | 1018 cold rolled steel | 68 | 29 | 136 | 219 | 18 | 39 | 7.6 | 5.6 |

What is claimed is:

1. A rotative abrasive flap wheel comprising an annulus of approximately equal-sized, substantially rectangular, substantially like-oriented, coated abrasive flaps, each of said coated abrasive flaps being characterized by having an abrasive face, an inner end and an opposite outer flap end, said coated abrasive flaps having said abrasive faces in the same direction and being interleaved with compressible, lofty, non-woven flaps characterized by having inner ends, opposite outer flap ends, a compressed thickness adjacent said inner end and an uncompressed thickness adjacent said outer flap end, said coated abrasive flaps and said non-woven flaps being fastened adhesively together at said inner ends by adhesive which extends along that portion of said flaps adjacent said inner ends part way into the annulus to define a zone comprised of solidified adhesive and with said outer flap ends being free, said inner ends of at least said coated abrasive flaps defining a tubular surface providing an opening capable of receiving an arbor, said inner ends of said non-woven flaps extending a distance at least partially into said zone so that said non-woven flap inner ends are sufficiently anchored to resist removal in use, said coated abrasive flaps and said non-woven flaps being present in said wheel to provide a number ratio of coated abrasive flaps to non-woven flaps in a range of about 15:1 to about 1:5, said compressed thickness being less than about 35% of said uncompressed thickness for non-woven flap inner ends extended to said tubular surface.

2. The flap wheel of claim 1 wherein said rotative abrasive flap wheel also includes opposed rigid circular plates, each of which has an axially aligned central opening coaxial with said tubular surface and a flange adapted to be received into opposed slots on each side of said wheel.

3. The flap wheel of claim 1 wherein said flanges are adhesively bonded into said slots.

4. The flap wheel of claim 1, wherein said non-woven flaps contain abrasive material adhesively bonded therein.

* * * * *